US009139389B2

(12) United States Patent
Uchino

(10) Patent No.: US 9,139,389 B2
(45) Date of Patent: Sep. 22, 2015

(54) SHEET CONVEYING DEVICE AND IMAGE RECORDING DEVICE

(71) Applicant: Yuta Uchino, Nagoya (JP)

(72) Inventor: Yuta Uchino, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 86 days.

(21) Appl. No.: 13/829,308

(22) Filed: Mar. 14, 2013

(65) Prior Publication Data

US 2013/0249161 A1 Sep. 26, 2013

(30) Foreign Application Priority Data

Mar. 26, 2012 (JP) ..... 2012-069066

(51) Int. Cl.

| | |
|---|---|
| ***B65H 5/00*** | (2006.01) |
| ***B65H 5/36*** | (2006.01) |
| ***B65H 3/06*** | (2006.01) |
| ***B65H 3/44*** | (2006.01) |
| ***B65H 3/66*** | (2006.01) |

(52) U.S. Cl.

CPC ..... *B65H 5/36* (2013.01); *B65H 3/0684* (2013.01); *B65H 3/44* (2013.01); *B65H 3/66* (2013.01); *B65H 2301/4454* (2013.01); *B65H 2402/441* (2013.01); *B65H 2404/6111* (2013.01); *B65H 2404/7414* (2013.01); *B65H 2405/332* (2013.01)

(58) Field of Classification Search

CPC .. B65H 3/44; B65H 2301/4454; B65H 39/06; B65H 5/062; B65H 2402/441; B65H 2404/6111; B65H 5/36; B65H 2404/7414; B65H 2404/741; B65H 2404/74; B65H 2405/332; B65H 3/0684; B65H 3/66; G03G 15/6558

USPC ..... 271/9.13, 264

See application file for complete search history.

(56) References Cited

U.S. PATENT DOCUMENTS

| | | | | |
|---|---|---|---|---|
| 6,105,953 | A * | 8/2000 | Komuro | 271/9.09 |
| 7,448,621 | B2 * | 11/2008 | Yasumoto | 271/264 |
| 7,819,394 | B2 * | 10/2010 | Shiohara et al. | 271/9.12 |
| 2009/0166966 | A1 * | 7/2009 | Nishikata et al. | 271/272 |
| 2010/0078872 | A1 * | 4/2010 | Asada et al. | 271/10.12 |

FOREIGN PATENT DOCUMENTS

JP 2010-083626 A 4/2010

* cited by examiner

*Primary Examiner* — Prasad Gokhale
(74) *Attorney, Agent, or Firm* — Baker Botts L.L.P.

(57) ABSTRACT

A first guide member and a second guide member define therebetween a first path. The second guide member and a third guide member define therebetween a second path. The second guide member pivots between a first position in which a first contact surface of a contact portion thereof is in contact with the first guide member, and a second position in which the first contact surface is separated from the first guide member. The third guide member pivots between a third position in which a third contact surface thereof is in contact with the second contact surface of the second guide member in the first position, and a fourth position in which the third contact surface is separated from the second guide member. The first, second, and third contact surfaces are disposed outer than the first path and the second path in a direction perpendicular to a sheet conveying direction.

19 Claims, 7 Drawing Sheets

TOP
BOTTOM
FRONT
REAR
7
8
70
71
62
35
46
33
61
34
43
72
47

SHEET CONVEYING DEVICE AND IMAGE RECORDING DEVICE

CROSS REFERENCE TO RELATED APPLICATION

This application claims priority from Japanese Patent Application No. 2012-069066, filed on Mar. 26, 2012, the entire disclosure of which is incorporated herein by reference.

BACKGROUND OF THE INVENTION

1. Field of the Invention

The present invention relates to a sheet conveying device configured to convey a sheet along one of a plurality of paths and to an image recording device comprising such a sheet conveying device.

2. Description of Related Art

A known sheet conveying device comprises a first guide member and a second guide member which are configured to define two conveying paths along which a sheet is selectively conveyed. The first guide and the second guide are configured to be pivotable relative to a main body of the sheet conveying device so as to open the conveying paths for sheet jam handling.

SUMMARY OF THE INVENTION

A need has arisen for a sheet conveying device that comprises a plurality of guide members configured to be pivotable while the guide members, when not pivoted, are positioned with high accuracy relative to each other such that a predetermined clearance is maintained between two opposing guide members.

According to an embodiment of the invention, a sheet conveying device comprises a first guide member, a second guide member disposed facing the first guide member to define therebetween a first curved path along which a sheet is to be conveyed in a first conveying direction, and a third guide member disposed facing the second guide member to define therebetween a second curved path along which a sheet is to be conveyed in a second conveying direction. The first guide member is opposite to the third guide member relative to the second guide member. The second guide member comprises a contact portion comprising a first contact surface and a second contact surface and is configured to pivot between a first position in which the first contact surface is in contact with the first guide member, and a second position in which the first contact surface is separated from the first guide member. The third guide member comprises a third contact surface and is configured to pivot between a third position in which the third contact surface is in contact with the second contact surface of the second guide member in the first position, and a fourth position in which the third contact surface is separated from the second guide member. The first contact surface, the second contact surface, and the third contact surface are disposed at positions outer than the first curved path and the second curved path in a width direction perpendicular to the first conveying direction.

According to another embodiment of the invention, a sheet conveying device comprising a first guide member, a second guide member, and a third guide member. The second guide member comprises a particular guide portion disposed facing the first guide member to define therebetween a first curved path along which a sheet is to be conveyed in a first conveying direction, and a contact portion disposed outer than the particular guide portion in a width direction perpendicular to the first conveying direction and comprising a first contact surface and a second contact surface. The third guide member comprises a further guide portion disposed facing the second guide member to define therebetween a second curved path along which a sheet is to be conveyed in a second conveying direction, and a third contact surface disposed outer than the further guide portion in the width direction. The first guide member is opposite to the third guide member relative to the second guide member. The second guide member is configured to pivot between a first position in which the first contact surface is in contact with the first guide member, and a second position in which the first contact surface is separated from the first guide member. The third guide member is configured to pivot between a third position in which the third contact surface is in contact with the second contact surface of the second guide member in the first position, and a fourth position in which the third contact surface is separated from the second guide member.

According to another embodiment of the invention, an image recording device comprises a first guide member, a second guide member disposed facing the first guide member to define therebetween a first curved path along which a sheet is to be conveyed in a first conveying direction, a third guide member disposed facing the second guide member to define therebetween a second curved path along which a sheet is to be conveyed in a second conveying direction, and recording unit configured to record an image on the sheet conveyed selectively along the first curved path and the second curved path. The first guide member is opposite to the third guide member relative to the second guide member. The second guide member comprises a contact portion comprising a first contact surface and a second contact surface and is configured to pivot between a first position in which the first contact surface is in contact with the first guide member, and a second position in which the first contact surface is separated from the first guide member. The third guide member comprises a third contact surface and is configured to pivot between a third position in which the third contact surface is in contact with the second contact surface of the second guide member in the first position, and a fourth position in which the third contact surface is separated from the second guide member. The first contact surface, the second contact surface, and the third contact surface are disposed at positions outer than the first curved path and the second curved path in a width direction perpendicular to the first conveying direction.

Other objects, features, and advantages will be apparent to persons of ordinary skill in the art from the following detailed description of the invention and the accompanying drawings.

BRIEF DESCRIPTION OF THE DRAWINGS

For a more complete understanding of the invention, the needs satisfied thereby, and the features and technical advantages thereof, reference now is made to the following descriptions taken in connection with the accompanying drawings.

DETAILED DESCRIPTION OF EMBODIMENTS

Embodiments of the invention and their features and technical advantages may be understood by referring to FIGS. 1-7D, like numerals being used for like corresponding parts in the various drawings.

Figure 1:
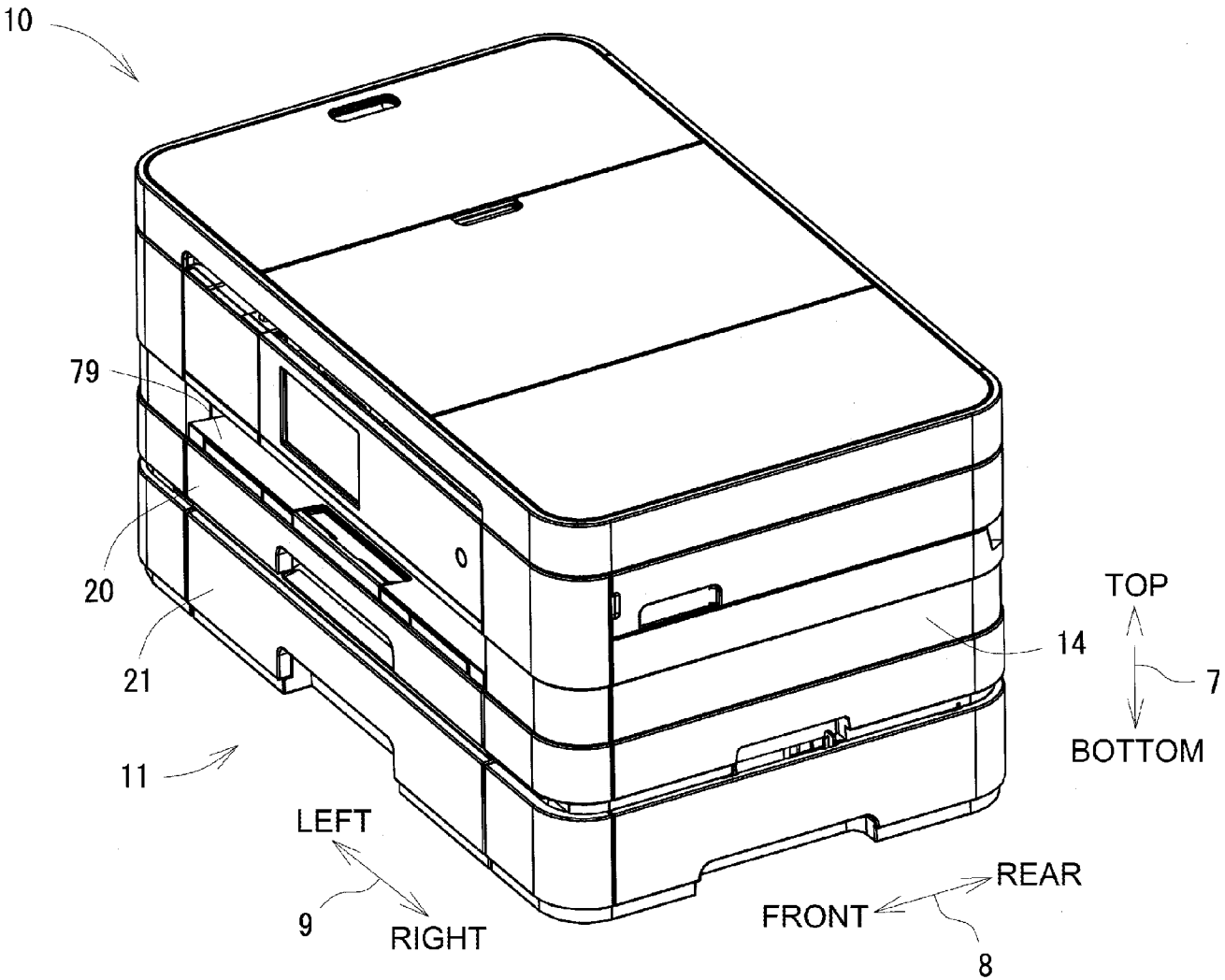
FIG. 1 is a front perspective view of a multi-function device according to an embodiment of the invention.

A multi-function device 10 is placed as shown in FIG. 1 when intended to be used. In this embodiment, a top-bottom direction 7, a front-rear direction 8, and a left-right direction 9 are defined as indicated by arrows in FIG. 1. In the subsequent description, the top-bottom direction 7 is defined on the basis of the state where the multi-function device 10 is usably placed (see FIG. 1). The front-rear direction 8 is defined on the basis of a front side of the multi-function device 10 on which a first feed tray 20 and a second feed tray 21 are mounted. The left-right direction 9 is defined as viewed from the front side of the multi-function device 10.

Figure 2A:
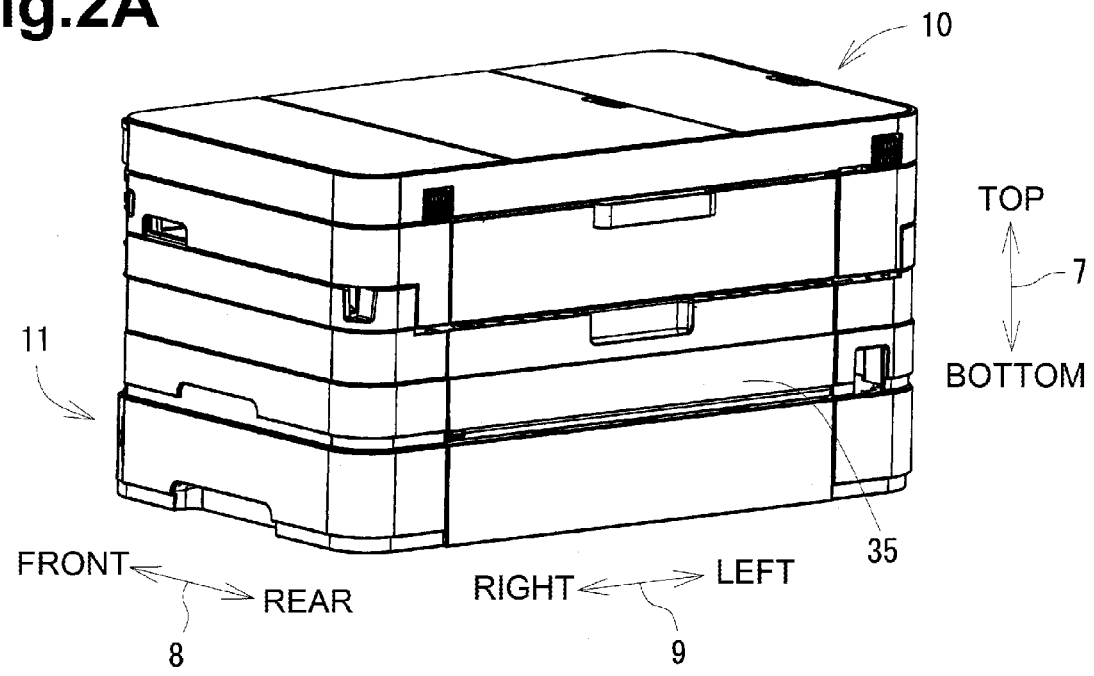
FIG. 2A is a rear perspective view of the multi-function device with a third guide member closed (with a second guide member in a first position and with a third guide member in a third position).
Figure 2B:
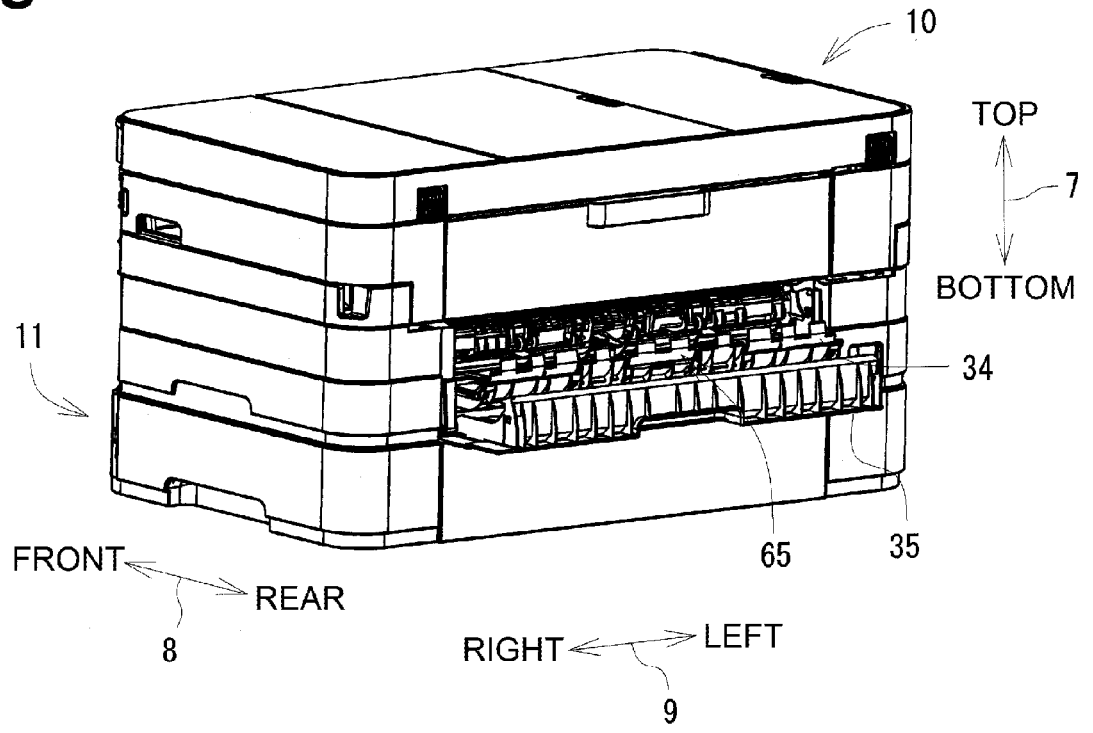
FIG. 2B is a rear perspective view of the multi-function device with the third guide member open (with the second guide member in a second position and with the third guide member in a fourth position).

As shown in FIGS. 1, 2A and 2B, the multi-function device 10, which is an example of a sheet conveying device and an image recording device, has a generally rectangular parallelepiped shape. The multi-function device 10 comprises an ink jet printer 11. The multi-function device 10 has various functions including a facsimile function and a printing function to record an image on a recording sheet 32 (see FIG. 3). Functions other than the printing function may be included in or excluded from the multi-function device 10. The printer 11 comprises a housing 14. A first feed tray 20 and a second feed tray 21 are configured to hold thereon recording sheets 32 of different sizes or types and are removably inserted in the housing 14. The first feed tray 20 is an example of a first tray, and the second feed tray 21 is an example of a second tray. In other words, the first feed tray 20 and the second feed tray 21 are removably inserted in the multi-function device 10. A discharged sheet holder 79 that receives the recording sheets 32 having images recorded thereon is disposed above the first feed tray 20 and the second feed tray 21.

As shown in FIGS. 2A and 2B, a third guide member 35 is disposed on the rear face of the multi-function device 10. The third guide member 35 outwardly opens a conveying path 65 upon being pivoted to an open position shown in FIG. 2B, from a closed position shown in FIG. 2A. Details of the third guide member 35 will be described later.

Figure 3:
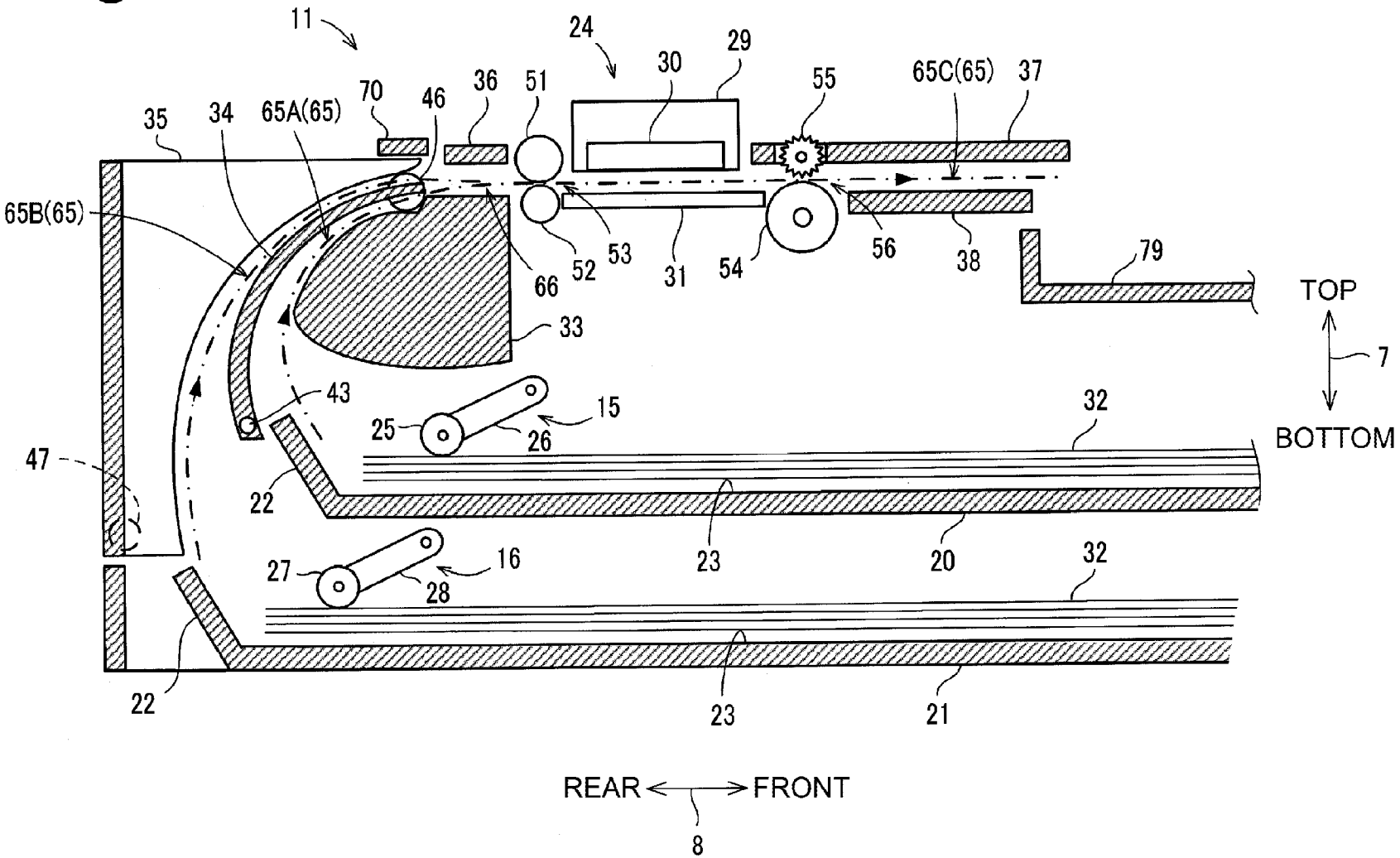
FIG. 3 is a schematic structural view of a printer of the multi-function device of FIG. 1.

As shown in FIG. 3, the printer 11 comprises feeders 15, 16 that feed the recording sheets 32 from the first feed tray 20 and the second feed tray 21, and an ink jet recording unit 24 disposed above the first feed tray 20 and configured to dispense ink droplets onto the recording sheet 32 for recording an image thereon.

As shown in FIG. 3, the feeder 15, which is an example of a first feeder, is disposed above the first feed tray 20, and the feeder 16, which is an example of a second feeder, is disposed above the second feed tray 21. The feeder 15 comprises a feed roller 25 and a feed arm 26. Likewise, the feeder 16 comprises a feed roller 27 and a feed arm 28. The feed rollers 25, 27 are driven to rotate by driving force of a feed motor (not shown) transmitted through a drive transmission mechanism (not shown) which comprises a plurality of gears engaged with each other. The feed motor and the drive transmission mechanism may be provided for each of the feed rollers 25, 27, or one or both may be shared by the feed rollers 25, 27.

The rotation of the feed motor is controlled by a control circuit (not shown) included in the printer 11. When the feed roller 25 is driven to rotate, the uppermost one of the recording sheets 32 stacked on the first feed tray 20 is fed into a first conveying path 65A. Likewise, when the feed roller 27 is driven to rotate, the uppermost one of the recording sheets 32 stacked on the second feed tray 21 is fed into a second conveying path 65B. The control circuit causes one of the feed rollers 25, 27 to rotate, to thereby supply the recording sheet 32 from the first feed tray 20 or the second feed tray 21 to the first conveying path 65A or the second conveying path 65B, respectively.

As shown in FIG. 3, the recording unit 24 is disposed above the first feed tray 20. The recording unit 24 comprises a carriage 29 and a recording head 30 mounted on the carriage 29. The carriage 29 reciprocates in the left-right direction 9 (in a direction perpendicular to the drawing sheet plane of FIG. 3).

A platen 31 configured to support the recording sheet 32 horizontally is disposed below the recording unit 24, at a position opposing the recording unit 24. The recording head 30 dispenses ink supplied from an ink cartridge (not shown) onto the recording sheet 32 being conveyed on the platen 31, while reciprocating in the left-right direction 9. As a result, an image is recorded on the recording sheet 32. However, the recording method of the recording unit 24 described above is merely an example, and the recording unit 24 may record an image by different methods, such as heat transfer printing.

As shown in FIG. 3, a first roller pair 53 comprises a first convey roller 51 and a pinch roller 52 and is disposed between a junction 66 and the recording unit 24. The pinch roller 52 is disposed below the first convey roller 51, and pressed against the surface of the first convey roller 51 by an elastic member such as a spring (not shown). The first roller pair 53 pinches therebetween the recording sheet 32 conveyed along the first conveying path 65A or the second conveying path 65B, and conveys the recording sheet 32 toward the recording unit 24.

A second roller pair 56 comprises a second convey roller 54 and a spur 55 and is disposed downstream of the platen 31 in a conveying direction. The spur 55 is disposed above the second convey roller 54, and pressed against the surface of the second convey roller 54 by an elastic member such as a spring (not shown). The second roller pair 56 pinches therebetween the recording sheet 32 on which an image has been recorded by the recording unit 24, and conveys the recording sheet 32 to the downstream side in the conveying direction, more specifically toward the discharged sheet holder 79.

The first convey roller 51 and the second convey roller 54 are driven to rotate by a convey motor (not shown) via a drive transmission mechanism (not shown). The convey motor and the drive transmission mechanism may be provided for each of the convey rollers 51, 55, or one or both may be shared by the convey rollers 51, 55. The rotation of the convey motor is controlled by the control circuit. The feed rollers 25, 27 may also be driven to rotate by the convey motor.

As shown in FIG. 3, the first feed tray 20 is attachable below the recording unit 24. The second feed tray 21 is attachable below the first feed tray 20. Upon being attached to the housing 14, the first feed tray 20 and the second feed tray 21 substantially overlap in the top-bottom direction 7.

The first feed tray 20 and the second feed tray 21 each comprises a holding surface 23 on which the recording sheets 32 are placed. The holding surface 23 has a rectangular shape in a view from above. The first feed tray 20 and the second feed tray 21 are configured to hold thereon the recording sheets 32 of different sizes or types. The type of the recording sheet 32 may be classified, for example, by thickness, material, surface finish, and so forth. The size or type of the recording sheet 32 to be placed on each holding surface 23 of the first feed tray 20 and the second feed tray 21 may be determined as appropriate. Here, the recording sheets 32 of the same size or type may be placed on both of the first feed tray 20 and the second feed tray 21.

The first feed tray 20 and the second feed tray 21 each comprise an inclined portion 22 which is inclined upwardly from its front to the rear. The inclined portion 22 is disposed at the rear end of the holding surface 23. The inclined portion 22 serves to lift a leading edge of the recording sheet 32 so as to guide the recording sheet 32 toward the first conveying path 65A or the second conveying path 65B. The holding surface 23, the inclined portion 22, and guide members defining the conveying path 65, which will be described later, extend in the left-right direction 9.

As shown in FIG. 3, the conveying path 65 is defined in the printer 11 so as to extend from the rear end of the first feed tray 20 or the second feed tray 21 to the discharged sheet holder 79 via the recording unit 24. The conveying path 65 is divided into the first conveying path 65A, the second conveying path 65B, and a third conveying path 65C. The first conveying path 65A extends from the rear end of the first feed tray 20 to the junction 66. The second conveying path 65B extends from the rear end of the second feed tray 21 to the junction 66. The third conveying path 65C continues to the first conveying path 65A and the second conveying path 65B and extends from the junction 66 to the discharged sheet holder 79. The conveying path 65 is defined by a first guide member 33, a second guide member 34, a third guide member 35, a fourth guide member 36, a fifth guide member 37, and a sixth guide member 38. The first guide member 33, the second guide member 34, and the third guide member 35 will be subsequently described in details.

The first conveying path 65A is a curved path extending from the rear end of the inclined portion 22 of the first feed tray 20 to the junction 66. The first conveying path 65A is generally in an arc shape. The recording sheet 32 fed from the first feed tray 20 is guided along the first conveying path 65A. A leading edge of the recording sheet 32 is lifted upward, and then the recording sheet 32 makes a U-turn toward the front side. The region in which the leading edge of the recording sheet 32 is directed to the front side corresponds to the junction 66.

The first conveying path 65A is defined by the first guide member 33 and the second guide member 34 that face each other. The first guide member 33 partially defines the first conveying path 65A from the front side (inner side), while the second guide member 34 partially defines the first conveying path 65A from the rear side (outer side).

The second conveying path 65B is a curved path extending from the rear end of the inclined portion 22 of the second feed tray 21 to the junction 66. The first conveying path 65B is generally in an arc shape, like the first conveying path 65A. The upstream portion of the second conveying path 65B in the conveying direction is located in the rear of the first conveying path 65A (in a rear outer side of the printer 11). The recording sheet 32 fed from the second feed tray 21 is guided along the second conveying path 65B. A leading edge of the recording sheet 32 is lifted upward, and then the recording sheet 32 makes a U-turn toward the front side. The region in which the leading edge of the recording sheet 32 is directed to the front side corresponds to the junction 66.

The second conveying path 65B is defined by the second guide member 34 and the third guide member 35 that face each other. The second guide member 34 partially defines the second conveying path 65B from the front side (inner side), while the third guide member 35 partially defines the second conveying path 65B from the rear side (outer side).

The third conveying path 65C is a linear path extending in the front-rear direction 8 from the junction 66 to the discharged sheet holder 79. The recording sheet 32 is guided frontward along the third conveying path 65C. The recording unit 24, the platen 31, the first roller pair 53, and the second roller pair 56 are disposed along the third conveying path 65C.

The third conveying path 65C is defined by the first guide member 33, the fourth guide member 36, the fifth guide member 37, and the sixth guide member 38, except for the portion of the third conveying path 65C where the recording unit 24, the platen 31, the first roller pair 53, and the second roller pair 56 are located. In the vicinity of the junction 66, the third conveying path 65C is defined by the first guide member 33 and the fourth guide member 36 that face each other in the top-bottom direction 7. A portion of the third conveying path 65C downstream of the recording unit 24 in the conveying direction is defined by the fifth guide member 37 and the sixth guide member 38 that face each other in the top-bottom direction 7.

Figure 4:
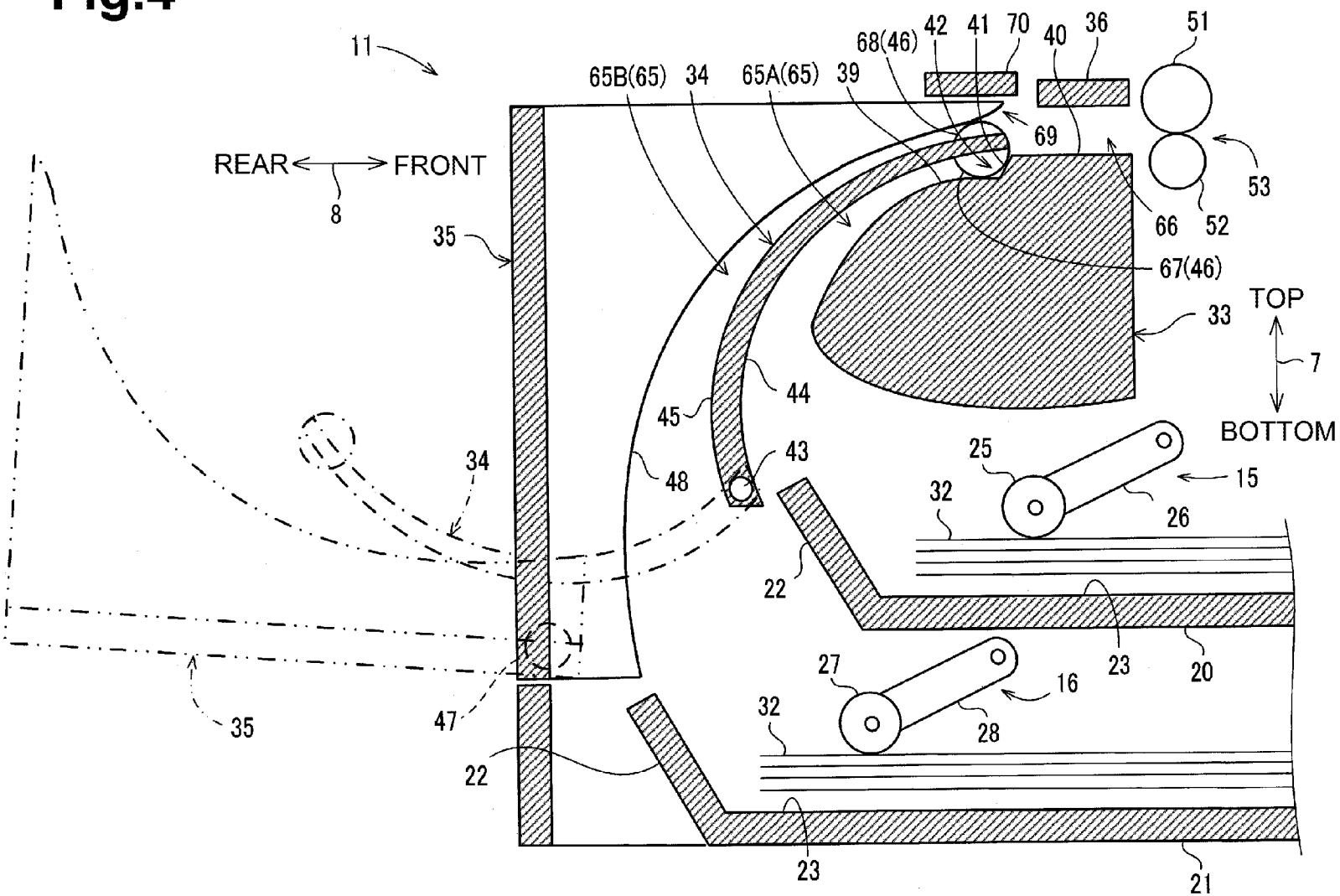
FIG. 4 is an enlarged view of a first conveying path, a second conveying path, and their vicinities shown in FIG. 3.

As shown in FIG. 4, the first guide member 33 is located above the first feed tray 20. The first guide member 33 comprises a first curved portion 39 and a supporting portion 40.

The first curved portion 39 is curved in an arcuate shape in a view in the left-right direction 9. The first curved portion 39 is disposed to face a second curved portion 44 of the second guide member 34 to be described later, and defines, from the front side, the first conveying path 65A. Tangential lines of the first curved portion 39 drawn in FIG. 4 become more parallel to the front-rear direction 8 at an upper position (further downstream in the conveying direction). At the downstream extremity of the first curved portion 39 in the conveying direction, the tangential line of the first curved portion 39 becomes substantially parallel to the front-rear direction 8.

The supporting portion 40 is formed on the front side (downstream side in the conveying direction) of the first curved portion 39, and at a higher position than the first curved portion 39. The fourth guide member 36 is disposed above the supporting portion 40. The region where the supporting portion 40 and the lower face of the fourth guide member 36 face each other corresponds to the junction 66.

A stepped portion is formed between the first curved portion 39 and the supporting portion 40. The stepped portion comprises a wall portion 41. The wall portion 41 is parallel to the top-bottom direction 7 or slightly inclined with respect thereto. The stepped portion may be construed as a cutout portion when viewed in the left-right direction 9. Hereafter, a region in the vicinity of the boundary between the first curved portion 39 and the wall portion 41 will be referred to as cutout portion 42. The cutout portion 42 is an example of a supporting portion and serves to support a cylindrical portion 46 of the second guide member 34 to be described later. The cutout portion 42 may not be necessarily formed all the way along the left-right direction 9 in FIG. 4. It suffices that the cutout portions 42 are formed on the respective end portions in the left-right direction 9 of the cylindrical portion 46. In the region between the cutout portions 42, the first curved portion 39 and the supporting portion 40 may be smoothly connected.

As shown in FIG. 4, the upstream portion of the second guide member 34 in the conveying direction is located above and in proximity to the first feed tray 20. In addition, the upstream portion of the second guide member 34 in the conveying direction is located in the rear of the first guide member 33. The second guide member 34 has a curved shape, and comprises, on a front side thereof, the second curved portion 44 and, on a rear side thereof, a third curved portion 45.

The second guide member 34 has an end portion pivotally supported by a first shaft 43 extending in the left-right direction 9. The first shaft 43 is an example of a pivot axis of the second guide member 34. The end portions of the first shaft 43 are supported, for example, by a member forming the housing 14. In FIG. 4, the first shaft 43 is located at a position corresponding to the rear end of the inclined portion 22 of the first feed tray 20. Alternatively, the first shaft 43 may be located at a position lower than the inclined portion 22. The second guide member 34 is pivotable about the first shaft 43 between a first position shown in solid lines in FIG. 4 and a second position shown in dash-dot lines. The first position and the second position refer to the positions of the second guide member 34 except for the first shaft 43.

As shown in FIG. 4, the second guide member 34 in the first position defines the first conveying path 65A and the second conveying path 65B. The second guide member 34 in the first position extends upward from the first shaft 43 located at the lowermost position. The second curved portion 44 on the inner side of the second guide member 34 faces the generally front side so as to cover the first guide member 33. The first conveying path 65A is defined by the second curved portion 44 and the first curved portion 39 of the first guide member 33 which face each other with a predetermined clearance therebetween.

The second guide member 34 comprises a pair of cylindrical portions 46 formed on an end thereof opposite to the first shaft 43, i.e., on a free end thereof on the downstream side in the conveying direction. The cylindrical portions 46 are an example of a contact portion. The cylindrical portion 46 has a cylindrical shape having a height along the left-right direction 9. The cylindrical portion 46 comprises a first contact portion 67 protruding from the second curved portion 44, and a second contact portion 68 protruding from the third curved portion 45. A lower surface of the first contact portion 67 and an upper surface of the second contact portion 68 are in a circular arc shape as viewed in the left-right direction 9 when the second guide member 34 is in the first position, and the two arcs are unified so as to form a generally circular bottom face of the cylindrical portion 46. The lower surface of the first contact portion 67 is an example of a first contact surface, and the upper surface of the second contact portion 68 is an example of a second contact surface. Here, the first contact portion 67 and the second contact portion 68 may not necessarily have a circular arc shape, but it suffices that the first contact portion 67 and the second contact portion 68 protrude in an arcuate shape from the second curved portion 44 and the third curved portion 45, respectively.

Figure 5:
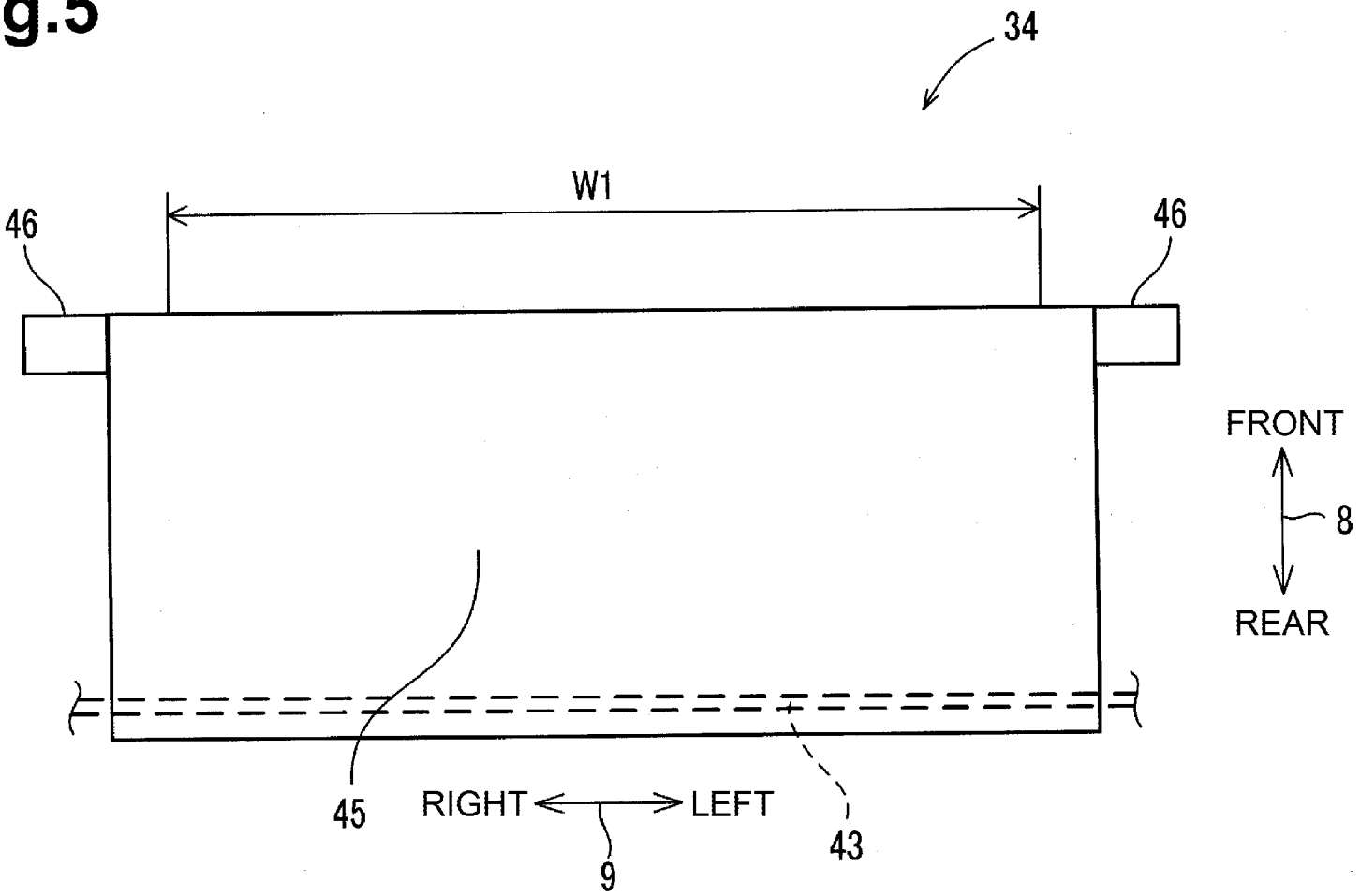
FIG. 5 is a plan view schematically showing a structure of the second guide member.

Referring now to FIG. 5, the cylindrical portions 46 are disposed on the respective end portions of the second guide member 34 in the left-right direction 9. A width W1 between the cylindrical portions 46 corresponds to a width of a region in the left-right direction 9 in which the recording sheet 32 is conveyed. Thus, the recording sheet 32 is conveyed between the cylindrical portions 46. The cylindrical portions 46 are disposed outer than the second curved portion 44 and the third curved portion 45 in the left-right direction 9, i.e., outer than the first conveying path 65A and the second conveying path 65B in the left-right direction 9. As shown in FIG. 4, the first contact portion 67 of the cylindrical portion 46 is supported, at two points of the circumference thereof, by the first curved portion 39 and the wall portion 41, respectively, as viewed in the left-right direction 9. The first curved portion 39 and the wall portion 41 forms the cutout portion 42. This configuration maintains the second curved portion 44 of the second guide member 34 at a position spaced from the first curved portion 39 by a predetermined clearance.

As shown in FIG. 4, the second guide member 34 in the second position is outwardly opened toward the rear of the printer 11. When the second guide member 34 is pivoted about the first shaft 43 from the first position to the second position, the first conveying path 65A is opened up to the outside. The pivotal movement of the second guide member 34 is stopped, for example, by a member forming the housing 14, such that the second guide member 34 is stopped in the second position. The third guide member 35 has to be in a fourth position in order to allow the second guide member 34 to pivot from the first position to the second position, as will be subsequently described in detail.

As shown in FIG. 4, an upstream portion of the third guide member 35 in the conveying direction is located above and in proximity to the rear end of the second feed tray 21. In addition, the upstream portion of the third guide member 35 is located in the rear of the second guide member 34. The third guide member 35 comprises a fourth curved portion 48 curved in an arcuate shape.

The third guide member 35 has an end portion pivotally supported by a second shaft 47 extending in the left-right direction 9. The second shaft 47 is an example of a pivot axis of the third guide member 35. The respective end portions of the second shaft 47 are supported, for example, by a member forming the housing 14. The second shaft 47 is located at a position lower than the first shaft 43 (on the upstream side in the conveying direction), to prevent interference with the pivotal movement of the second guide member 34. The cylindrical portion 46 of the second guide member 34 is closer to the first shaft 43 than to the second shaft 47. The second shaft 47 is located on the rear side of the inclined portion 22 of the second feed tray 21. The third guide member 35 is pivotable about the second shaft 47 between a third position shown in solid lines in FIG. 4 and the fourth position shown in dash-dot lines. Here, the third position and the fourth position refer to the positions of the third guide member 35 except for the second shaft 47.

As shown in FIG. 4, the third guide member 35 in the third position defines the second conveying path 65B. The third guide member 35 in the third position extends upward from the second shaft 47 located at the lowermost position. The fourth curved portion 48 of the third guide member 35 faces the generally front side, so as to cover the second guide member 34 in the first position. The second conveying path 65B is defined by the fourth curved portion 48 and the third curved portion 45 of the second guide member 34 which face each other with a predetermined clearance therebetween.

The third guide member 35 comprises a third contact portion 69 formed on an end thereof opposite to the second shaft 47, i.e., on a free end thereof on the downstream side in the conveying direction. When the third guide member 35 is in the third position, the third contact portion 69 is in contact with the second contact portion 68 of the second guide member 34 in the first position. In addition, the third contact portion 69 in the third position is inclined with respect to the left-right direction 9. More specifically, when the third guide member 35 is in the third position, a lower surface of the third contact portion 69 is in contact with the upper surface of the second contact portion 68. The lower surface of the third contact portion 69 is an example of a third contact surface. The third contact portion 69 is formed at each of the end portions of the third guide member 35 in the left-right direction 9, so as to make contact with the second contact portions 68. In other words, the third contact portions 69 are disposed outer than the fourth curved portion 48 in the left-right direction 9, i.e., outer than the second conveying path 65B in the left-right direction 9.

Figure 6B:
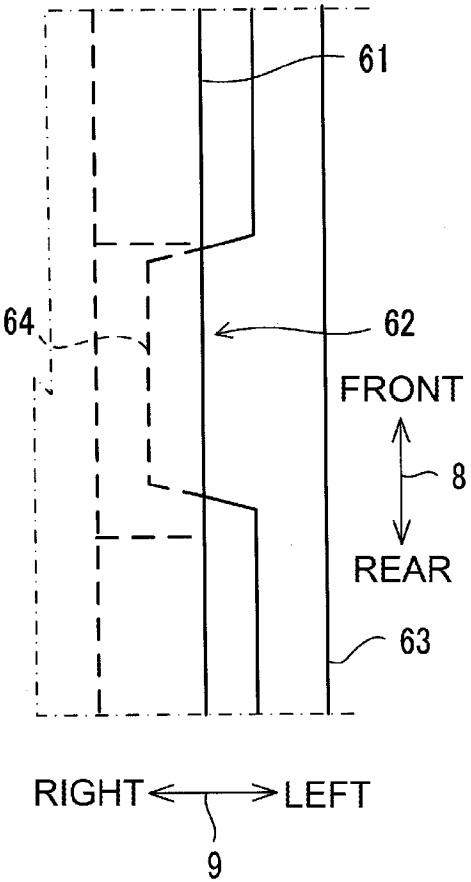
FIG. 6B is a schematic view showing a state in which an engaging protrusion is engaged in a through hole of a housing.
Figure 6A:
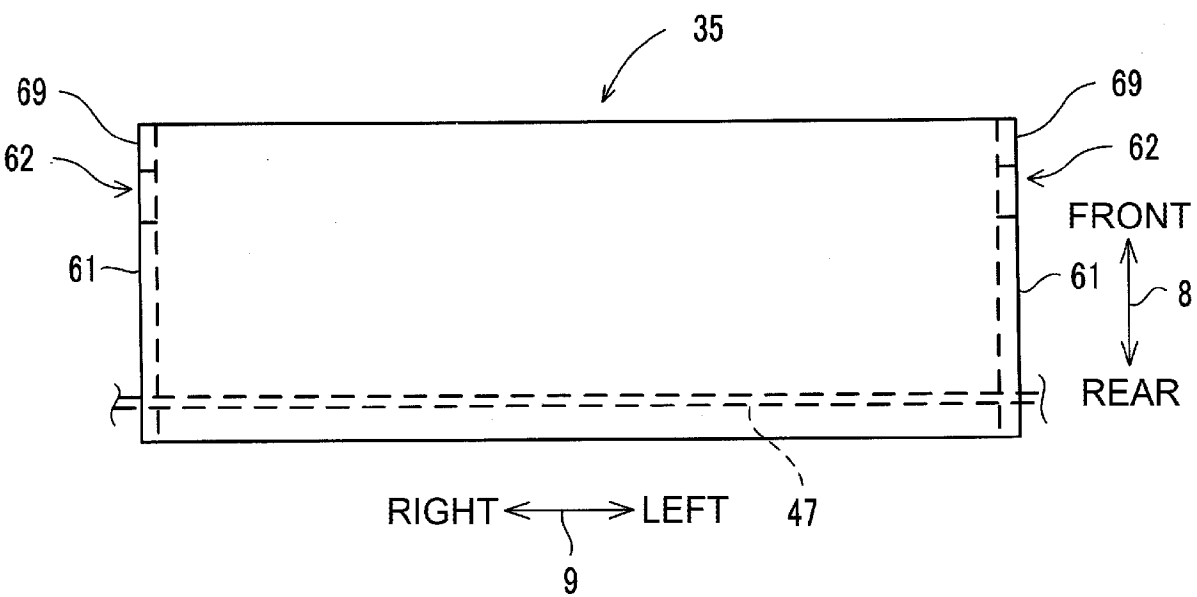
FIG. 6A is a plan view schematically showing a structure of the third guide member.

Referring to FIG. 6A, the third guide member 35 comprises sidewalls 61 respectively formed on the end portions of the third guide member 35 in the left-right direction 9. The sidewalls 61 each have a through hole 62 penetrating therethrough in the left-right direction 9. As shown in FIG. 6B, an engaging portion 63 which is a part of the housing 14 (see FIG. 1) is provided on the outer side of each of the sidewalls 61. The engaging portion 63 includes an engaging protrusion 64 protruding toward the through hole 62 of the sidewall 61.

When the third guide member 35 is pivoted from the third position toward the fourth position, the engaging protrusion 64 is released from the through hole 62 and is moved onto the sidewall 61. Accordingly, the engaging protrusion 64 is outwardly pressed in the left-right direction 9, and the engaging portion 63 is bent such that the engaging protrusion 64 is located on the outer side of the sidewall 61 in the left-right direction 9. In other words, the engaging portion 63 is elastically deformed outwardly in the left-right direction 9. When the third guide member 35 is pivoted to the third position, the through hole 62 opposes the engaging protrusion 64, and the engaging protrusion 64 is fitted into the through hole 62 by the elastic restoring force of the engaging portion 63 (FIG. 6B). At this point, the engaging protrusion 64 presses at least a front periphery which partially defines the through hole 62. Accordingly, the third guide member 35 is urged in the direction from the fourth position toward the third position in FIG. 4, i.e., in the direction in which the third contact portion 69 presses the second contact portion 68 of the cylindrical portion 46. Thus, the elastic force of the engaging portion 63 restoring itself from the bent state urges the third guide member 35. Here, instead of the through hole 62 penetrating the sidewall 61, a recess or the like may be formed on the sidewall 61, provided that the aforementioned effect can be secured.

Consequently, the cylindrical portion 46 of the second guide member 34 is held by and between the cutout portion 42 of the first guide member 33 and the third contact portion 69 of the third guide member 35, such that the second guide member 34 is maintained in the first position.

A pressing portion 70 forming a part of the housing 14 is disposed on an upper side of the third guide member 35 in the third position. When the third guide member 35 is pivoted to the third position, the free end of the third guide member 35 enters a region under the pressing portion 70. Accordingly, the pressing portion 70 is elastically deformed slightly upward, and elastically urges the third guide member 35 toward the first guide member 33. Consequently, the third guide member 35 is maintained in the third position by the third contact portion 69 thereof supported by the second contact portion 68 of the cylindrical portion 46, the engaging portion 63, and the pressing portion 70.

As shown in FIG. 4, the third guide member 35 in the fourth position is outwardly opened toward the rear of the printer 11. When the third guide member 35 is pivoted about the second shaft 47 from the third position to the fourth position, the second conveying path 65B is opened up to the outside.

When the image recording is performed, the second guide member 34 is in the first position and the third guide member 35 is in the third position (see FIG. 3). To record an image on the recording sheet 32 in the first feed tray 20, the recording sheet 32 is fed to the first conveying path 65A by the feeder 15. The recording sheet 32 slides along the second curved portion 44 and makes a U-turn toward the front side. Then the recording sheet 32 passes the junction 66 and is conveyed along the third conveying path 65C, during which the recording unit 24 records an image on the recording sheet 32. The recording sheet 32 on which the image has been recorded is discharged onto the discharged sheet holder 79.

To record an image on the recording sheet 32 in the second feed tray 21, the recording sheet 32 is fed to the second conveying path 65B by the feeder 16. The recording sheet 32 slides along the fourth curved portion 48 and makes a U-turn toward the front side. Thereafter, the same process as described above is performed for the recording sheet 32 conveyed from the second feed tray 21.

To remove the recording sheet 32 jammed in the second conveying path 65B, the user pivots the third guide member 35 in the third position to the fourth position, to thereby outwardly open up the second conveying path 65B. After removing the recording sheet 32, the user pivots the third guide member 35 back to the third position, thereby allowing the printer 11 to perform the image recording.

To remove the recording sheet 32 jammed in the first conveying path 65A, the user first pivots the third guide member 35 in the third position to the fourth position, to thereby outwardly open up the second conveying path 65B. Then the user pivots the second guide member 34 in the first position to the second position, thus to outwardly open up the first conveying path 65A. After removing the recording sheet 32, the user again pivots the second guide member 34 back to the first position, and then the third guide member 35 back to the third position, thereby allowing the printer 11 to perform the image recording.

According to the foregoing embodiment, the third guide member 35 presses the second guide member 34 toward the first guide member 33 with the urging force exerted on the third guide member 35. The first contact portion 67 of the second guide member 34 is supported by the cutout portion 42 of the first guide member 33. In addition, the third contact portion 69 of the third guide member 35 is supported by the second contact portion 68 of the second guide member 34. Since the second guide member 34 is thus held between the contact portion 69 of the third guide member 35 and the cutout portion 42 of the first guide member 33, the respective guide members are retained with high positional accuracy. More specifically, the clearances of the first conveying path 65A and the second conveying path 65B properly set for guiding the recording sheet 32 can be maintained regardless of the repeated pivotal movements of the second guide member 34 and the third guide member 35. Therefore the conveying operation of the recording sheet 32 along the first conveying path 65A and the second conveying path 65B can be stabilized. In addition, the recording sheet 32 can be readily removed simply by pivoting the third guide member 35 to open up the second conveying path 65B or by pivoting the third guide member 35 and the second guide member 34 to open up the first conveying path 65A.

The third guide member 35 is subjected to the urging force only when the engaging protrusion 64 is fitted in the through hole 62, which prevents the third guide member 35 in the fourth position from accidentally returning to the third position. Therefore, the user can be released from the trouble of holding the third guide member 35 with his/her hand when removing the recording sheet 32 with the third guide member 35 pivoted to the fourth position. Further, the aforementioned effect can be attained simply by forming the through hole 62 in the third guide member 35 and forming the engaging protrusion 64 on the housing 14, which leads to reduction in manufacturing cost.

The third guide member 35 in the third position is further pressed toward the first guide member 33 by the pressing portion 70. This configuration further assures the close contact among the guide members.

Further, the cylindrical portion 46 has a circular shape when viewed in the left-right direction 9, which contributes to stabilizing the contact status of the cylindrical portion 46 with the first guide member 33 and the third guide member 35. In particular, the first contact portion 67 is supported at two points by the first curved portion 39 and the wall portion 41 which form the cutout portion 42. This configuration prevents the cylindrical portion 46 from being displaced with respect to the first guide member 33, thus increasing the positional stability of the cylindrical portion 46. In addition, since the cylindrical portion 46 is provided on each of the end portions of the second guide member 34 in the left-right direction 9, the second guide member 34 is prevented from inclining with respect to the left-right direction 9, and the cylindrical portions 46 are prevented from disturbing the movement of the recording sheet 32 passing therebetween.

Further, since the second shaft 47 is located below and in the rear of the first shaft 46 (i.e., on the upstream side in the conveying direction), the pivotal movement of the second guide member 34 is not disturbed by the second shaft 47 and the third guide member 35.

Figures 7A, 7B, 7C, 7D:
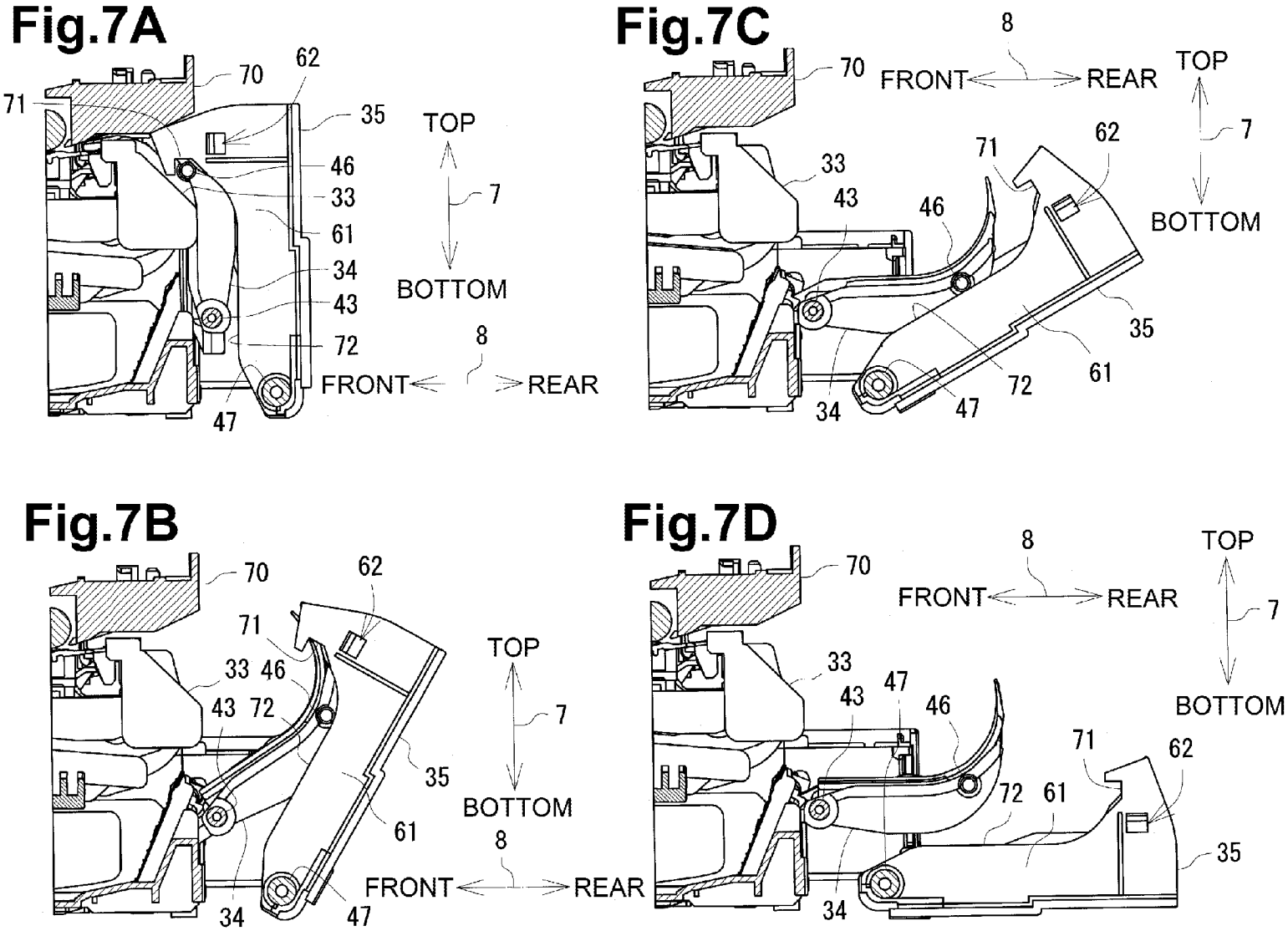
FIG. 7A-7D are views of a first guide member, a second guide member, and a third guide member of a printer of a multi-function device, according to another embodiment of the invention.

A multi-function device 10, which is an example of a sheet conveying device and an image recording device, according to another embodiment of the invention will be described hereunder. In this embodiment, as shown in FIGS. 7A to 7D, guide members are formed in different shapes from those of the multi-function device 10 in the above-described embodiment. A cylindrical portion 46 of a second guide member 34 is held by and between a first guide member 33 and a third guide member 35 in a third position, such that the second guide member 34 is maintained in a first position. The third guide member 35 comprises a hook portion 71 which is engageable with the cylindrical portion 46 of the second guide member 34. The hook portion 71 is located on a free end portion of a sidewall 61. The hook portion 71 is engaged with the cylindrical portion 46 when the second guide member 34 is in the first position and the third guide member 35 is in the third position (FIG. 7A).

When the user pivots the third guide member 35 toward a fourth position (clockwise in FIGS. 7A to 7D), the cylindrical portion 46 moves together with the hook portion 71, and hence a force to pivot the second guide member 34 toward a second position is applied to the second guide member 34. When the second guide member 34 and the third guide member 35 are pivoted by a predetermined angle, the cylindrical portion 46 is separated from the hook portion 71 toward a second shaft 47 of the third guide member 35. This is because a first shaft 43 is located in the rear of the second shaft 47 (on the upstream side of the second shaft 47 in the conveying direction). Thus, the cylindrical portion 46 and the hook portion 71 are disengaged from each other (FIG. 7B).

The second guide member 34 is urged to pivot toward the second position by its self-weight. Upon being disengaged from the hook portion 71, the cylindrical portion 46 of the second guide member 34 contacts an edge portion 72 of the sidewall 61. The edge portion 72 extends continuously from the hook portion 71. When the third guide member 35 is pivoted toward the fourth position, the second guide member 34 pivots toward the second position while the cylindrical portion 46 thereof slides along the edge portion 72.

The second guide member 34 stops pivoting in the second position (FIG. 7C). Thereafter, the third guide member 35 continues to pivot toward the fourth position, and hence the cylindrical portion 46 of the second guide member 34 is separated from the edge portion 72. The third guide member 35 stops pivoting in the fourth position (FIG. 7D). Thus, the user can pivot the second guide member 34 to the second position, simply by pivoting the third guide member 35 toward the fourth position.

The second guide member 34 and the third guide member 35 return to the state shown in FIG. 7A through reverse actions of the aforementioned steps. Specifically, when the user pivots the third guide member 35 toward the third position, the cylindrical portion 46 makes contact with the edge portion 72, and then slides along the edge portion 72 while the second guide member 34 is pivoted toward the first position. When the third guide member 35 reaches the third position, the second guide member 34 reaches the first position, and the hook portion 71 is engaged with the cylindrical portion 46.

According to the embodiment depicted in FIGS. 7A-7D, since the user can outwardly open up the first conveying path 65A and the second conveying path 65B simply by pivoting the third guide member 35, the user can readily remove the recording sheet 32 jammed in the first conveying path 65A or the second conveying path 65B. When the third guide member 35 is pivoted back to the third position after removing a jammed sheet, the second guide member 34 is positioned into the first position with high accuracy.

In the embodiment depicted in FIGS. 1-6B, the third guide member 35 may be located in the rear of the second feed tray 21. In this case, the third guide member 35 is disposed such that a part of the fourth curved portion 48 of the third guide member 35 partially defines the second conveying path 65B.

The third guide member 35 may be urged toward the second guide member 34 by different methods from that in the embodiment depicted in FIGS. 1-6B. For example, a coil spring provided coaxial with the second shaft 47 may be employed to urge the third guide member 35. Alternatively, a magnet may be employed to urge the third guide member 35.

The first guide member 33, the second guide member 34, and the third guide member 35 may be in contact with each other in different configurations from those in the embodiment depicted in FIGS. 1-6D. For example, the first guide member 33 and the third guide member 35 may include a recess having an arcuate shape as viewed in the left-right direction 9, so as to fit the circumferential surface of the first contact portion 67 or the second contact portion 68. Conversely, the first guide member 33 and the third guide member 35 may include a protrusion having an arcuate shape as viewed in the left-right direction 9, and the second guide member 34 may include recesses that fit the protrusions.

Although the printer 11 in the embodiment depicted in FIGS. 1-6B is configured to record an image on one face of the recording sheet 32, the printer 11 may be configured to record an image on both faces of the recording sheet 32. In this case, an additional conveying path, through which the recording sheet having an image recorded on a face thereof by the recording unit 24 is conveyed back to the first conveying path 65A, may be provided above the first feed tray 20.

Although, in the embodiment depicted in FIGS. 1-6B, the sheet conveying device is applied to the image recording device, the sheet conveying device may be applied to different devices. For example, the sheet conveying device may be applied to a wrapping apparatus configured to convey wrapping sheets in the process of wrapping the products.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. A sheet conveying device comprising:

a first guide member;

a second guide member disposed facing the first guide member to define therebetween a first curved path along which a sheet is to be conveyed in a first conveying direction; and a third guide member disposed facing the second guide member to define therebetween a second curved path along which a sheet is to be conveyed in a second conveying direction, wherein the first guide member is opposite to the third guide member relative to the second guide member, wherein the second guide member comprises a rod extending in a width direction perpendicular to the first conveying direction, the rod comprising a first contact surface and a second contact surface, and the second guide member being configured to pivot between a first position in which the first contact surface of the rod is in contact with the first guide member, and a second position in which the first contact surface of the rod is separated from the first guide member, wherein the third guide member comprises a third contact surface and is configured to pivot between a third position in which the third contact surface is in contact with the second contact surface of the rod of the second guide member in the first position, and a fourth position in which the third contact surface is separated from the second guide member, wherein the first contact surface and the second contact surface of the rod, and the third contact surface are disposed at positions outside of the first curved path and the second curved path in the width direction, and wherein when the second guide member is in the first position and the third guide member is in the third position, the rod of the second guide member is sandwiched between the first guide member and the third guide member while the first contact surface and the second contact surface of the rod are in contact with the first guide member and the third contact surface, respectively, thereby defining the first curved path and the second curved path.

2. The sheet conveying device according to claim 1, further comprising an urging member configured to urge the third contact surface of the third guide member against the second contact surface of the second guide member when the second guide member is in the first position and the third guide member is in the third position.

3. The sheet conveying device according to claim 1, further comprising a housing which comprises a pressing portion configured to press the third contact surface of the third guide member toward the first guide member when the third guide member is in the third position.

4. The sheet conveying device according to claim 1, further comprising a housing which comprises a protrusion, wherein the third guide member comprises a recess-defining portion which defines a recess in the third guide member, and the protrusion is configured to engage the recess of the third guide member in the third position and to press the recess-defining portion such that the third guide member is urged toward the first guide member.

5. The sheet conveying device according to claim 1, wherein the first contact surface of the rod of the second guide member has an arcuate shape protruding toward the first guide member, and the second contact surface of the rod has an arcuate shape protruding toward the third contact surface of the third guide member, the first contact surface facing away from the second contact surface.

6. The sheet conveying device according to claim 1, wherein the first guide member comprises a supporting portion configured to support, at two points thereof, the first contact surface of the rod of the second guide member.

7. The sheet conveying device according to claim 1, wherein the rod of the second guide member is disposed at each of opposite ends of the second guide member in the width direction, and wherein the third contact surface of the third guide member is disposed at each of opposite ends of the third guide member in the width direction.

8. The sheet conveying device according to claim 1, wherein a pivot axis of the second guide member is located downstream, in the conveying direction, of a pivot axis of the third guide member.

9. The sheet conveying device according to claim 1, wherein the rod of the second guide member is closer to a pivot axis of the second guide member than to a pivot axis of the third guide member.

10. The sheet conveying device according to claim 1, the rod of the second guide member is disposed at one end portion of the second guide member which is opposite to the other end portion thereof through which a pivot axis of the second guide member passes.

11. The sheet conveying device according to claim 1, wherein the rod of the second guide member protrudes in the width direction, and wherein the third guide member further comprises a hook portion disposed at a free end portion thereof and configured to, when pivoting from the third position toward the fourth position, hook the rod of the second guide member such that the second guide member pivots from the first position toward the second position.

12. The sheet conveying device according to claim 11, wherein the third guide member further comprises an edge portion extending from the hook portion toward a pivot axis of the third guide member, and the rod of the second guide member is configured to slide away from the hook portion along the edge portion when third guide member pivots toward the fourth position.

13. The sheet conveying device according to claim 1, further comprising:

a first tray configured to hold sheets thereon, wherein the sheet is to be conveyed from the first tray along the first curved path.

14. The sheet conveying device according to claim 13, further comprising a second tray disposed below the first tray and configured to hold sheets thereon, wherein the sheet is to be conveyed from the second tray along the second curved path.

15. The sheet conveying device according to claim 14, wherein the contact portion of the second guide member is disposed at one end portion of the second guide member which is opposite to the other end closer to the first tray and the second tray.

16. The sheet conveying device according to claim 1, wherein the sheet is to be conveyed along the first curved path upward.

17. The sheet conveying device according to claim 1, wherein the sheet is to be conveyed along the second curved path upward.

18. A sheet conveying device comprising:

a first guide member;

a second guide member comprising:

a particular guide portion disposed facing the first guide member to define therebetween a first curved path along which a sheet is to be conveyed in a first conveying direction; and a cylindrical member disposed outside of the particular guide portion in a width direction perpendicular to the first conveying direction to extend in the width direction, the cylindrical member comprising a first contact surface and a second contact surface; and a third guide member comprising:

a further guide portion disposed facing the second guide member to define therebetween a second curved path along which a sheet is to be conveyed in a second conveying direction; and a third contact surface disposed outside of the further guide portion in the width direction, wherein the first guide member is opposite to the third guide member relative to the second guide member, wherein the second guide member is configured to pivot between a first position in which the first contact surface of the cylindrical member of the second guide member is in contact with the first guide member, and a second position in which the first contact surface of the cylindrical member is separated from the first guide member, wherein the third guide member is configured to pivot between a third position in which the third contact surface is in contact with the second contact surface of the cylindrical member of the second guide member in the first position, and a fourth position in which the third contact surface is separated from the second guide member, and wherein when the second guide member is in the first position and the third guide member is in the third position, the cylindrical member of the second guide member is sandwiched between the first guide member and the third guide member while the first contact surface and the second contact surface of the cylindrical member are in contact with the first guide member and the third contact surface, respectively, thereby defining the first curved path and the second curved path.

19. An image recording device comprising:

a first guide member;

a second guide member disposed facing the first guide member to define therebetween a first curved path along which a sheet is to be conveyed in a first conveying direction;

a third guide member disposed facing the second guide member to define therebetween a second curved path along which a sheet is to be conveyed in a second conveying direction; and a recording unit configured to record an image on the sheet conveyed selectively along the first curved path and the second curved path, wherein the first guide member is opposite to the third guide member relative to the second guide member, wherein the second guide member comprises a rod extending in a width direction perpendicular to the first conveying direction, the rod comprising a first contact surface and a second contact surface, and the second guide member being configured to pivot between a first position in which the first contact surface of the rod is in contact with the first guide member, and a second position in which the first contact surface of the rod is separated from the first guide member, wherein the third guide member comprises a third contact surface and is configured to pivot between a third position in which the third contact surface is in contact with the second contact surface of the rod of the second guide member in the first position, and a fourth position in which the third contact surface is separated from the second guide member, wherein the first contact surface and the second contact surface of the rod, and the third contact surface are disposed at positions outside of the first curved path and the second curved path in the width direction, and wherein when the second guide member is in the first position and the third guide member is in the third position, the rod of the second guide member is sandwiched between the first guide member and the third guide member while the first contact surface and the second contact surface of the rod are in contact with the first guide member and the third contact surface, respectively, thereby defining the first curved path and the second curved path.

* * * * *